United States Patent [19]

Beitner

[11] 4,089,184

[45] May 16, 1978

[54] HAND CASE

[75] Inventor: Shlomo Beitner, Tel-Aviv, Israel

[73] Assignee: Bipol Ltd., Tel-Aviv, Israel

[21] Appl. No.: 708,571

[22] Filed: Jul. 26, 1976

[51] Int. Cl.[2] ..... F25B 21/02

[52] U.S. Cl. ..... 62/3

[58] Field of Search ..... 62/3, 457

[56] References Cited

U.S. PATENT DOCUMENTS

| | | | |
|---|---|---|---|
| 2,610,472 | 9/1952 | Maxwell | 62/457 |
| 2,614,397 | 10/1952 | Petty | 62/457 |
| 3,048,020 | 8/1962 | Jones | 62/3 |
| 3,111,166 | 11/1963 | Munz et al. | 62/3 |
| 3,194,023 | 7/1965 | Sudmeier | 62/3 |
| 3,194,024 | 7/1965 | Bassetti, Jr. | 62/3 |
| 3,214,922 | 11/1965 | Koblischek | 62/3 |
| 3,234,595 | 2/1966 | Weichselbaum et al. | 62/3 |
| 3,664,143 | 5/1972 | Carroll | 62/3 |

*Primary Examiner*—Lloyd L. King
*Attorney, Agent, or Firm*—Gordon W. Hueschen

[57] ABSTRACT

A hand case is provided with a cooling compartment cooled by a self-contained thermoelectric element of the Peltier type. All of the elements required to operate the thermoelectric element are within the confines of the hand case.

18 Claims, 5 Drawing Figures

HAND CASE

BACKGROUND OF THE INVENTION

1. Field of Invention

The invention relates to a hand case or like carrying case having a cooling compartment therein which is adapted for use by diabetics and like persons who need to carry insulin or other medication with them in their day-to-day business, and must needs keep the medication cool.

2 Prior Art

The need for small, portable refigerators for keeping insulin and like medication cool is recognized in the art as shown by U.S. Pat. No. 3,713,302. In this patent, the cooling is effected by a thermoelectric unit of the Peltier type, but because inadequate means for dissipating heat is provided, the hot face of the thermoelectric unit must be spaced a substantial distance from the cold face thereof. Moreover, the problem of heat dissipation is further complicated if the portable refrigerator is carried in a hand case or other carrying case. Also, the cover mechanism for insuring effective closure of the cooling compartment is complicated and likely to be unreliable.

OBJECTS OF THE INVENTION

It is an object of the invention to provide an effective means for carrying personal doses of insulin and like medication which has to be kept cool. It is a further object of the invention to provide a hand case having effective cooling means therein. It is a further objective of the invention to provide such a case having an effective means for dissipating the heat generated in the cooling. It is a further object of the invention to provide a simple and effective closure means. It is a further object of the invention to make it possible to utilize thermoelectric elements of the Peltier type in which the cold face is in proximity to the hot face. It is a further object of the invention to avoid the disadvantages of the prior art and to obtain such advantages as will appear as the description proceeds.

SUMMARY OF THE INVENTION

The invention relates to a hand case having a cooling compartment, which hand case comprises side and bottom walls and a cover, and has arranged therein an insulated compartment which divides the hand case into a main compartment and an auxiliary compartment, which insulated compartment is cooled by means of a thermoelectric element of the Peltier type having a cold face and a hot face arranged with the cold face in heat-transfer with the interior of the insulated compartment and the hot face in heat-transfer with the air in the auxiliary compartment, the hand case being provided with grill means in the auxiliary compartment which permits the inflow and outflow of air in and out of the auxiliary compartment.

Advantageously, the hot face of the thermoelectric element is in heat-transfer with a heat dissipating means located in the auxiliary compartment. Also advantageously, the grill means comprises at least two grills at an angle to each other whereby cross ventilation is provided. Preferably, one of the grills is in the bottom of the auxiliary compartment, and the case is provided wih means for keeping the bottom of the auxiliary compartment spaced from whatever surface the hand case may be deposited upon, so that that grill is always accessible to the ambient atmosphere.

The heat dissipating means advantageously comprises a thermal sink in heat-transfer contact with radiating sheets. Preferably, there are a plurality of alternating thermal sinks and radiating sheets, with the radiating sheets having a greater expanse than the thermal sinks and with the thermal sinks progressively diminishing in cross-sectional area.

Advantageously, the cold face of the thermoelectric element is in direct heat-transfer contact with an internal thermal sink which is imbedded in the insulation of the insulated material, and which in turn is in heat-transfer with the interior of the insulated compartment. Desirably, the insulated compartment has a lining of heat conducting material which is in heat-transfer contact with the internal thermal sink. The internal thermal sink advantageously has a portion the same size and shape as the cold face of the thermoelectric unit, which extends inwardly from the cold face and has an enlarged portion having a flange projecting laterally beyond said first-named portion. Advantageously, the hot face of the thermoelectric element is in heat-transfer contact with an external thermal sink, and the two thermal sinks are fastened together by means which place the thermoelectric element in compression between them.

Advantageously, the thermoelectric element has its cold portion, roughly the inner half of the element, imbedded in the insulation of the insulated compartment and the hot portion, roughly the outer half of the thermoelectric element, exposed to the air in the auxiliary compartment. In this way, heat-transfer from the hot face to the cold face is minimized.

Advantageously, the external thermal sink and the internal thermal sink are bolted together with bolts provided with Bellville or spring washers to compensate thermal expansion.

The thermoelectric element is energized by batteries contained in the auxiliary compartment and, desirably, is provided with jack means whereby the hand case can be plugged into an external power source, either for energizing the thermoelectric element, or for recharging the batteries. Thus, as desired, the hand case can be operated from its internal power source or from an external power source, which latter can also be used to recharge the internal power source, namely, the batteries.

Advantageously, the insulated compartment has a cover which is apposed to the cover of the hand case, which in turn has means for pressing on the cover of the insulated container to securely hold it in its closed position when the hand case cover is in its closed position.

Thus, there is provided a hand case or other carrying case having an insulated compartment therein, cooled by a thermoelectric element of the Peltier type, which is effective for the purpose intended and which accomplishes the object of the invention.

DETAILED DESCRIPTION OF THE INVENTION

Figure 1:
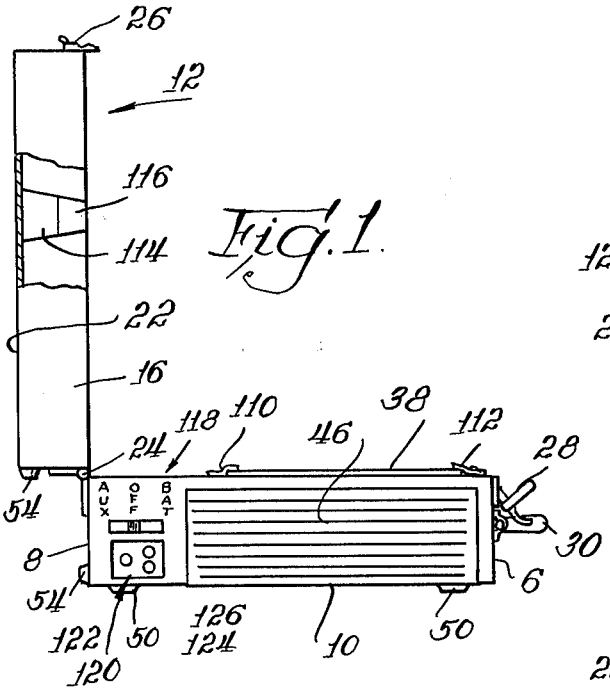
FIG. 1 is a side elevation of the hand case with the cover in open position.
Figure 2:
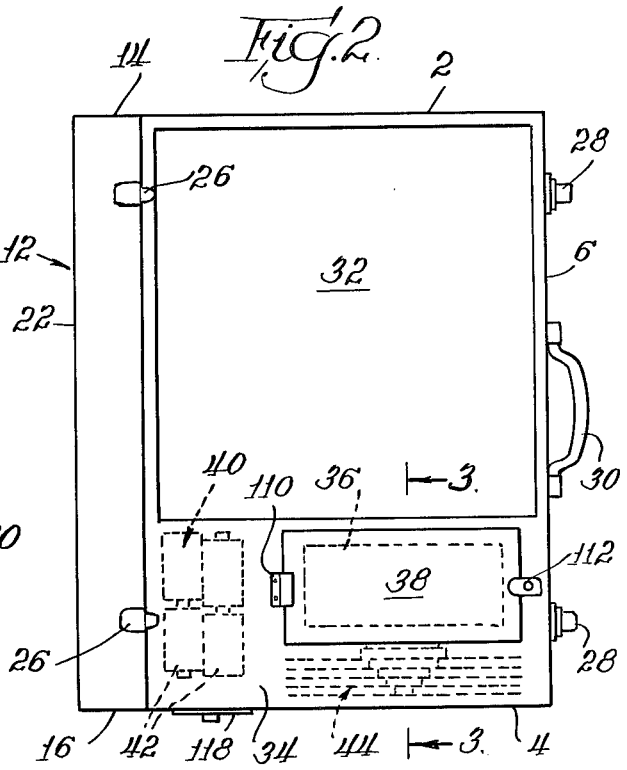
FIG. 2 is a plan view of FIG. 1.

In FIGS. 1 and 2, there is shown a hand case having sidewalls comprising end sides 2 and 4 and front and back sides 6 and 8, and a bottom side 10. There is also shown a cover 12, having end sides 14 and 16, and front and back sides 18 and 20, and a top 22. Suitable hinges are provided at 24, and suitable latches at 26–28; also a suitable handle at 30. All the above is typical of a conventional briefcase or attache case, or other conventional carrying case of the hand case type. The bottom portion of the hand case is divided into a main compartment 32, and an auxiliary compartment 34. In the auxiliary compartment is an insulated compartment 36, having a cover 38. Also, in the auxiliary compartment is a battery 40, composed of a plurality of cells 42, of a number required to make up the desired EMF. For example, eight 1½ volt cells are required to produce a 12 volt source. Also in the auxiliary compartment 36 is heat-dissipating means 44.

The auxiliary compartment 36 has grills 46 and 48, advantageously located in the end wall 4 and the bottom 10. These grills permit the inflow and outflow of ambient air into and out of the auxiliary compartment 36. The heat-dissipating means 44 is located in the auxiliary compartment in a position which is between the two grills. The bottom 10 of the case is provided with buttons or legs 50, which space the grill 48 from a desk or any other surface on which the hand case may be deposited, thus allowing access of the ambient air to the grill 48. Thus, ambient air passes in grill 48, comes in contact with the heat-dissipating means 44, and by the normal convection caused by the heating of the air, passes on out through grill 46.

The case is also provided with buttons or feet 54, on the rear sides 8 and 22, but these, unlike the buttons or feet 50, do not affect the inflow and outflow of air. When the case is deposited on the bottom sides with the handle uppermost, air flows in at the bottom portions of the grills 46 and 48, and out the top portions thereof.

The thermoelectric module or element 56 has a hot face 58 and a cold face 60. The cold face is in heat-transfer contact with an internal thermal sink 62, which is imbedded in the insulation 45, and which in turn is in heat-transfer contact with the heat-conducting lining 43. Thus, heat from the interior of the insulated compartment is conducted by the heat-conducting lining 43, into the iternal thermal sink 62, and then into the thermoelectric element which functions to transfer it to the hot face 58. The hot face 58 is in heat-transfer contact with a thermal sink 64 which, in turn, is in heat-transfer contact with a radiating sheet 66 of greater expanse than the thermal sink 64. Second, third, fourth, and fifth thermal sinks 68, 70, 72, and 74 respectively, may be provided, which alternate with radiating sheets 76, 78, 80, 82, and 83 respectively. Each successive thermal sink has a smaller cross-section than the preceeding one, and the several thermal sinks, advantageously, have the same thickness whereby the radiating sheets are spaced uniformly apart. If desired, the successive radiating sheets may have diminished cross-sectional area, but in all cases the radiating sheets have a greater expanse than the thermal sinks with which they are in contact, and thus provide radiating fins for conducting heat from the thermal sinks into the surrounding atmosphere.

The insulating material 45 covers the cold portion of the thermoelectric element or module, but not the hot portion; thus the hot portion of the thermoelectric element is exposed to the ambient air in the auxiliary compartment, and the cold face 60 is separated therefrom by the insulating material.

Figure 4:
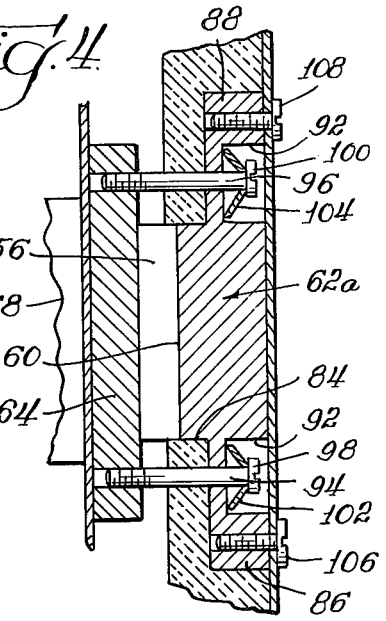
FIG. 4 is a partial view in section of a modified form of FIG. 3.

In the modified form of the invention shown in FIG. 4, the internal thermal sink 62a has a portion 84 which has essentially the same shape and size as the cold face 60 of the thermoelectric element and extends inwardly therefrom. Optimally, the portion 84 has the same size as the cold face 60, but desirably, may be slightly larger to insure against misalignment during assembly. The remaining portion has a larger expanse than the portion 84 and has outwardly projecting flanges 86 and 88, which may extend all around the portion 30 or only from opposite sides thereof. The flanges 84 and 86 are provided with wells 90 and 92 adapted to receive the bolts 94 and 96, which pass through the flanges 86 and 88, and are threaded into the external thermal sink 64. The heads 98 and 100 of the bolts 94 and 96 are separated from the flanges 86 and 88 by Bellville or spring washers 102 and 104 which function to compensate thermal expansion. The bolts 94 and 96 may be constructed of non-heat conducting material, and/or they may be insulated from the flanges 86 and 88 by insulating washers not shown. By tightening up the bolts 98 and 100, the thermoelectric element 56 is placed in compression between the two thermal sinks **62*a* and 64, so that the hot and cold surfaces of the thermoelectric element 56** are in good heat-transfer contact with the thermal sinks.

The heat conducting lining 43 is secured in good heat-transfer contact with the thermal sink **62*a* by means of bolts or other fastening means 106 and 108**.

Figure 3:
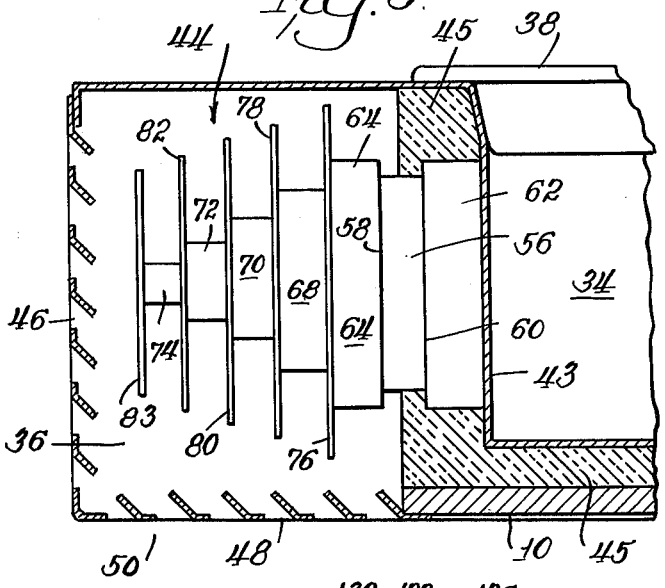
FIG. 3 is a partial view in section along line 3—3 of FIG. 2.

It will be seen that, by virtue of the portion 84 which is of essentially the same size and shape as the cold face of the thermoelectric element 56, the insulating material is thicker adjacent the thermoelectric element than in the modification shown in FIG. 3. Thus, if the portion 84 projects from the cold face 62 inwardly a substantial distance, say from one-half to three or four times the thickness of the thermoelectric element 56, the thickness of the insulating material adjacent the thermoelectric element will be one or more times the thickness of the thermoelectric element, whereas, in the modification shown in FIG. 3, the thickness there is only about one-half times the thickness of the thermoelectric element. Thus, heat-transfer from the cold face 60 of the thermoelectric element, or from the thermal sink **62*a*, is substantially less than in the modification shown in FIG. 3**.

The cover 38, which is also insulated and fits closely into the insulated compartment, may be provided with a hinge 110 and a latch 112, or not, as desired, but in any case, it is desirable that the cover 12 of the case have a member 114 adapted to press against the cover 38 when the cover 12 is in closed position. The presser member 114 may have a cap 116 of resilient material. Thus, when the cover 12 is in closed position, the presser element 114 with its resilient cap 116 presses on the cover 38 and holds it in tight engagement in its closed position.

In FIG. 1 there is shown a switch 118 which can be a single pole double throw switch capable of switching from auxiliary to battery, or a single pole triple throw switch capable of switching from auxiliary to off to battery. There is also shown in FIG. 1 a jack 120, which is a recessed male jack having one common prong 122, and two polarized prongs 124 and 126.

Figure 5:
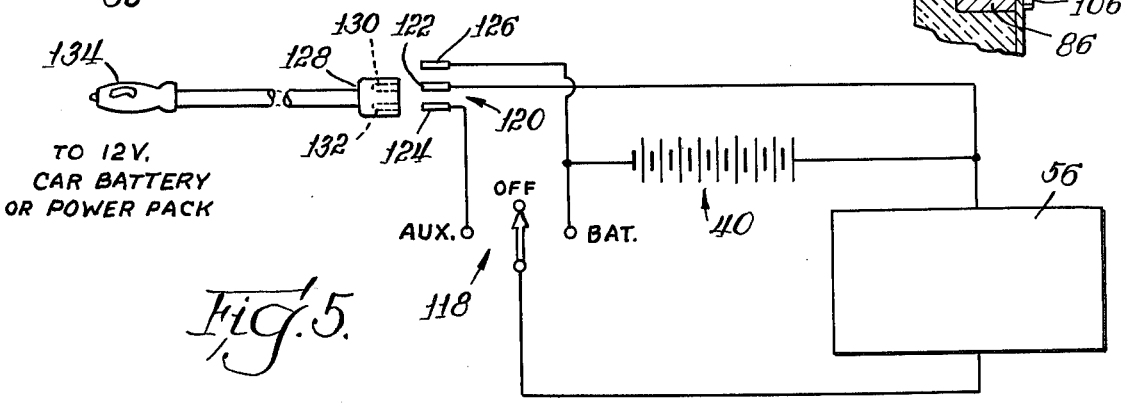
FIG. 5 is a schematic diagram of the circuitry.

FIG. 5 shows the schematic hook-up to the switch 118 and the plug 120. The female plug 128 has one common receptor 130, and one polarized receptor 132, and is connected with a car battery adaptor 134. The female plug 128 can be inserted with its common receptor 130 receiving the common prong 122, and its polarized receptor 132 receiving the polarized prong 124, or it can be plugged in with the common receptor 130 receiving the common prong 122, and the polarized receiver 132 receiving the polarized prong 126. In the first position, when the switch is to auxiliary, the thermoelectric element will be energized by the car battery, and when the switch is at battery, it will be energized by the battery pack 40. When the plug 28 is in the other position, it will either charge the battery pack 40, that is, when the switch 118 is in the off position, or it will both charge the battery pack 40 and energize the thermoelectric element when the switch 18 is in the battery position.

As illustrated in FIG. 5, there are eight batteries which, at one and one-half volts each, provide twelve volts, which is voltage attainable from a car battery. It will be understood, however, that it may be desirable to operate the thermoelectric element at a higher or lower EMF and that, for this purpose, the plug 128 can be connected to a power supply supplying the desired EMF, which is either activated by a car battery of six or twelve volts, or by an alternating current of one hundred and ten volts.

It will thus be seen that there is provided a hand case having an insulated compartment and means for cooling the same, which is entirely self-contained and which effectively cools the insulated compartment and dissipates the heat generated.

The thermoelectric elements used in the units are well known in the art. Generally, they are made up of a plurality of electrically connected P-N type crystals and faced with electrical insulating material which may be an epoxy resin, or, more desirably, a heat conducting ceramic material. If desired, heat transfer can be promoted by coating these faces with a heat conducting grease, for example, a silicone grease.

It is to be understood that the invention is not to be limited to the exact details of operation or materials of construction shown and described, as obvious variations and equivalents will be apparent to one skilled in the art.

I claim:

1. A hand case having a cooling compartment which comprises side and bottom walls and a cover; a main compartment, an auxiliary compartment, and an insulated compartment between said main compartment and said auxiliary compartment; a thermoelectric element having a cold face and a hot face arranged with the cold face in heat-transfer with the interior of said insulated compartment and with its hot face in heat-transfer with the air in said auxiliary compartment; and grill means in said auxiliary compartment permitting the inflow and outflow of air in and out of said auxiliary compartment; said auxiliary compartment being L-shaped, with one leg of said L housing a heat-dissipating means for effecting the heat-transfer from said hot face to the air in said auxiliary compartment, and the other leg thereof housing batteries for energizing said thermoelectric element.

2. The hand case of claim 1, in which the grill means comprises at least two grills at an angle to each other whereby to provide cross-ventilation of said auxiliary compartment.

3. The hand case of claim 2, in which one of said grills is in the bottom of said auxiliary compartment, and means is provided to keep the same spaced from whatever surface the hand case may be deposited upon, and accessible to the ambient atmosphere.

4. The hand case of claim 1, in which said heat-dissipating means comprises a plurality of thermal sinks in heat-transfer contact with heat-radiating sheets.

5. The hand case of claim 4, in which the heat-radiating sheets are uniformly spaced and the thermal sinks progressively diminish in cross-sectional area.

6. The hand case of claim 4, in which the hot face of said thermoelectric element is in direct heat-transfer with an external thermal sink which in turn is in direct heat-transfer with a radiating sheet of larger expanse than said external thermal sink, which sheet is in turn in direct heat-transfer contact with a second external thermal sink of smaller expanse than said first-named external thermal sink, which in turn is in contact with a second radiating sheet of larger expanse than said second external thermal sink.

7. The hand case of claim 1, in which the cold face of said thermoelectric element is in direct heat-transfer contact with an internal thermal sink which is imbedded in the insulation of said insulated compartment and which in turn is in heat-transfer with the interior of said insulated compartment.

8. The hand case of claim 7, in which the insulated compartment has a lining of heat-conducting material and in which said internal thermal sink is in direct heat-transfer contact with said heat conducting lining.

9. The hand case of claim 8, in which said internal thermal sink has a portion of the same size and shape as the cold face of said thermoelectric element, and which extends inwardly from said cold face, and an enlarged portion having a flange projecting laterally beyond said first-named portion.

10. The hand case of claim 7, in which the hot face of said thermoelectric element is in heat-transfer contact with an external thermal sink, and in which fastening means is provided for fastening one of said thermal sinks to the other and placing the thermoelectric element in compression between them.

11. The hand case of claim 10, in which the hot face portion of said thermoelectric element is imbedded in the insulation of said insulated compartment, and the cold face portion is exposed to the air in said auxiliary compartment.

12. The hand case of claim 11, in which said internal thermal sink has a portion of the same size and shape as the cold face of said thermoelectric element, and which extends inwardly from said cold face, and an enlarged portion having a flange projecting laterally from said first-named portion, and in which said fastening means is attached to said flange.

13. A hand case having a cooling compartment which comprises side and bottom walls and a cover, an insulated compartment therein dividing said hand case additionally into a main compartment and an auxiliary compartment, a thermoelectric element having a cold face and a hot face arranged with the cold face in heat-transfer with the interior of said insulated compartment, and with its hot face in heat-transfer with the air in said auxiliary compartment, and grill means in said auxiliary compartment permitting the inflow and outflow of air in and out of said auxiliary compartment, in which the cold face of said thermoelectric element is in direct heat-transfer contact with an internal thermal sink which is imbedded in the insulation of said insulated compartment and which in turn is in heat-transfer with the interior of said insulated compartment, in which the hot face of said thermoelectric element is in heat-transfer contact with an external thermal sink, and in which fastening means is provided for fastening one of said thermal sinks to the other and placing the thermoelectric element in compression between them, in which the hot face portion of said thermoelectric element is imbedded in the insulation of said insulated compartment, and the hot face portion is exposed to the air in said auxiliary compartment, in which said internal thermal sink has a portion of the same size and shape as the cold face of said thermoelectric element, and which extends inwardly from said cold face, and an enlarged portion having a flange projecting laterally from said first-named portion, and in which said fastening means is attached to said flange, and in which the fastening means comprises bolt means recessed in said flange and provided with spring washers to compensate thermal expansion.

14. The hand case of claim 13, in which the insulated compartment has a lining of heat-conducting material and in which said internal thermal sink is in direct heat-transfer contact with said heat conducting lining, and in which said lining is fastened to the inner face of said internal thermal sink in heat-transfer contact therewith.

15. The hand case of claim 1, in which the auxiliary compartment contains batteries to energize said thermoelectric element.

16. A hand case having a cooling compartment which comprises side and bottom walls and a cover, an insulated compartment therein dividing said hand case additionally into a main compartment and an auxiliary compartment, a thermoelectric element having a cold face and a hot face arranged with the cold face in heat-transfer with the interior of said insulated compartment, and with its hot face in heat-transfer with the air in said auxiliary compartment, and grill means in said auxiliary compartment permitting the inflow and outflow of air in and out of said auxiliary compartment, in which the auxiliary compartment contains batteries to energize said thermoelectric element, and in which the case is provided with jack means whereby the hand case can be plugged into an external power supply.

17. The hand case of claim 16, in which means is provided whereby the hand case can be operated on said batteries or on said external power supply, and whereby the batteries can be recharged.

18. The hand case of claim 1, in which the insulated compartment has a cover apposed to the cover of said hand case and in which the hand case cover has means thereon which in the closed position securely holds the insulated compartment cover in its closed position.

* * * * *

UNITED STATES PATENT AND TRADEMARK OFFICE

CERTIFICATE OF CORRECTION

PATENT NO. : 4,089,184

DATED : May 16, 1978

INVENTOR(S) : Shlomo Beitner

It is certified that error appears in the above-identified patent and that said Letters Patent are hereby corrected as shown below:

[56] References Cited; "3,194,024 7/1965 Bassetti, Jr." should read --3,194,024 7/1965 Bassett, Jr.--; Office Actions, attachment to Paper 2, Dated January 25, 1977.

Col. 1, line 13; "refigerators" should read --refrigerators--

Col. 2, line 57; "object" should read --objects--

Col. 3, line 49; "iternal" should read --internal--

Col. 3, line 53; "66" should read --76--

Col. 5, line 14; "28" should read --128--

Signed and Sealed this

*Twenty-first* Day of *November 1978*

[SEAL]

*Attest:*

RUTH C. MASON
*Attesting Officer*

DONALD W. BANNER
*Commissioner of Patents and Trademarks*